US011158472B2

(12) United States Patent
Komori et al.

(10) Patent No.: US 11,158,472 B2
(45) Date of Patent: Oct. 26, 2021

(54) ELECTRIC CIRCUIT BREAKER DEVICE

(71) Applicant: Daicel Corporation, Osaka (JP)

(72) Inventors: Shogo Komori, Tokyo (JP); Yu Tanaka, Tokyo (JP)

(73) Assignee: DAICEL CORPORATION, Osaka (JP)

( * ) Notice: Subject to any disclaimer, the term of this patent is extended or adjusted under 35 U.S.C. 154(b) by 27 days.

(21) Appl. No.: 16/639,450

(22) PCT Filed: Sep. 6, 2018

(86) PCT No.: PCT/JP2018/032960
§ 371 (c)(1),
(2) Date: Feb. 14, 2020

(87) PCT Pub. No.: WO2019/054261
PCT Pub. Date: Mar. 21, 2019

(65) Prior Publication Data

US 2021/0134547 A1 May 6, 2021

(30) Foreign Application Priority Data

Sep. 12, 2017 (JP) ..... JP2017-174596

(51) Int. Cl.
*H01H 39/00* (2006.01)

(52) U.S. Cl.
CPC ..... *H01H 39/006* (2013.01); *H01H 2039/008* (2013.01)

(58) Field of Classification Search
CPC ..... H01H 39/006; H01H 2039/008
See application file for complete search history.

(56) References Cited

U.S. PATENT DOCUMENTS 6,222,439 B1 4/2001 Tanigawa et al.
6,556,119 B1 * 4/2003 Lell ..... H01H 39/006 337/157

(Continued)

FOREIGN PATENT DOCUMENTS

JP 11-232979 A 8/1999
JP 2000-149747 A 5/2000

(Continued)

*Primary Examiner* — Jacob R Crum
(74) *Attorney, Agent, or Firm* — Birch, Stewart, Kolasch & Birch, LLP

(57) ABSTRACT

To provide an electric circuit breaker device including a conduction part that can be easily cut. An electric circuit breaker device includes a housing made of synthetic resin, a rod-like projectile made of synthetic resin and arranged in the housing, a conductor portion arranged in the housing to extend across a front face of one end portion of the rod-like projectile, and an igniter arranged in the housing to face another end portion of the rod-like projectile and configured to generate pressure to fire the rod-like projectile toward the conductor portion. In one embodiment, the conductor portion includes a first conductor plate extending across the front face of the one end portion of the rod-like projectile and including a recess portion, and a second conductor plate coupled to the recess portion of the first conductor plate. In another example, the conductor portion includes a first conductor plate arranged on the front face of one end portion of the rod-like projectile, and a second conductor plate and a third conductor plate coupled, at a corresponding one of edge portions of the second conductor plate and the third conductor plate, to respective opposing edge portions of the first conductor plate.

9 Claims, 10 Drawing Sheets

(56) References Cited

U.S. PATENT DOCUMENTS

| | | | | |
|---|---|---|---|---|
| 2005/0083164 | A1 | 4/2005 | Caruso et al. | |
| 2005/0083165 | A1 | 4/2005 | Tirmizi | |
| 2010/0218659 | A1* | 9/2010 | Ukon ..... | B23D 15/145 83/639.1 |
| 2012/0234162 | A1 | 9/2012 | Tirmizi | |
| 2013/0126326 | A1 | 5/2013 | Borg | |
| 2013/0255463 | A1* | 10/2013 | Ukon ..... | H01H 39/006 83/639.1 |
| 2014/0061161 | A1 | 3/2014 | Nakamura et al. | |
| 2017/0221662 | A1 | 8/2017 | Sakai | |

FOREIGN PATENT DOCUMENTS

| | | | |
|---|---|---|---|
| JP | 2013-512539 | A | 4/2013 |
| JP | 2014-49300 | A | 3/2014 |
| JP | 2016-85947 | A | 5/2016 |

* cited by examiner

ELECTRIC CIRCUIT BREAKER DEVICE

TECHNICAL FIELD

The present invention relates to an electric circuit breaker device that can be used in an electric circuit for a vehicle, electric home appliance, or the like.

BACKGROUND ART

Electric circuit breaker devices are used to prevent great damage, for example, under abnormal conditions of an electric circuit itself of a vehicle, electric home appliance, or the like, or the entire system including a battery of the electric circuit, by interrupting the electric circuit. Electric circuit breaker devices are becoming particularly important for electric circuits of electric vehicles. As examples of an electric circuit breaker device, those including an igniter, a projectile (piston), a conductor, and the like within a housing are known (US2005/0083164A, US2005/0083165A, US2012/0234162A, JPH11-232979A, JP2014-49300A, and JP2016-85947A).

Known electric circuit breaker devices typically include a single conductor plate as a conductor that is cut by a projectile, and the conductor plate is provided with a notch groove to facilitate cutting of the conductor plate. However, a portion, of the conductor plate, in which the notch groove is provided is thinner than the other portions, and, for this reason, heat build-up occurs at the portion of the conductor plate upon energization. In order to suppress such heat build-up, the plate needs to be thicker, but this causes an increase in size of the devices.

SUMMARY OF INVENTION

The present invention (one embodiment) provides an electric circuit breaker device including a housing made of synthetic resin, a rod-like projectile made of synthetic resin and arranged in the housing, a conductor portion arranged in the housing to extend across a front face of one end portion of the rod-like projectile, and an igniter arranged in the housing to face another end portion of the rod-like projectile and configured to generate pressure to fire the rod-like projectile toward the conductor portion, in which electric circuit breaker device the conductor portion includes a first conductor plate extending across the front face of the one end portion of the rod-like projectile and including a recess portion, and a second conductor plate coupled to the recess portion of the first conductor plate.

The present invention (another embodiment) provides an electric circuit breaker device including a housing made of synthetic resin, a rod-like projectile made of synthetic resin and arranged in the housing, a conductor portion arranged in the housing to extend across a front face of one end portion of the rod-like projectile, and an igniter arranged in the housing to face another end portion of the rod-like projectile and configured to generate pressure to fire the rod-like projectile toward the conductor portion, in which electric circuit breaker device the conductor portion includes a first conductor plate arranged on the front face of the one end portion of the rod-like projectile, and a second conductor plate and a third conductor plate that are coupled, at a corresponding one of edge portions of the second conductor plate and the third conductor plate, to respective opposing edge portions of the first conductor plate.

BRIEF DESCRIPTION OF DRAWINGS

The present invention will be more fully understood from the detailed description given herein below and the accompanying drawings, which are given for explanation only and do not limit the present invention.

DESCRIPTION OF EMBODIMENTS

Figure 1:
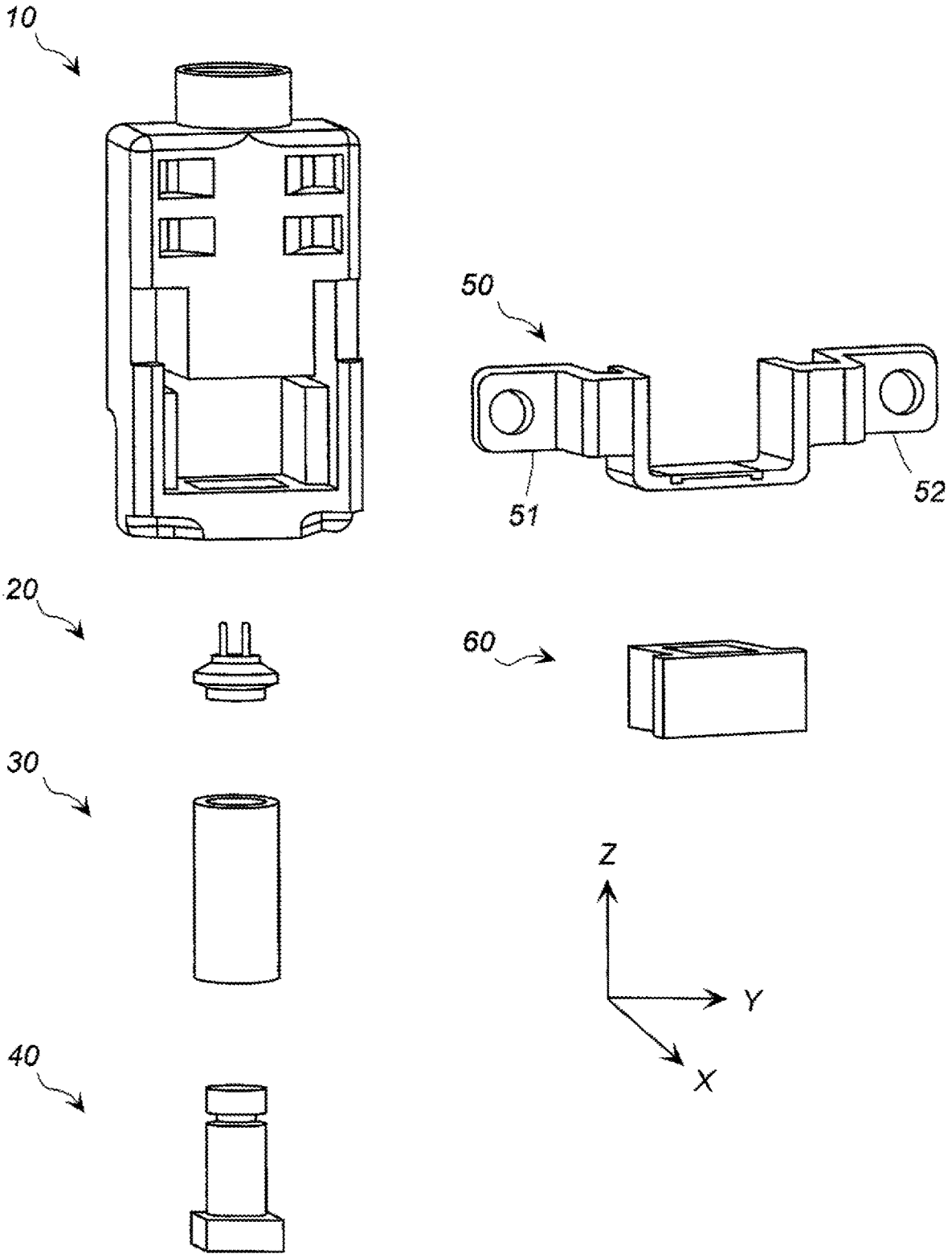
FIG. 1 is an exploded perspective view illustrating an electric circuit breaker device according to one embodiment of the present invention.

An object of the present invention is to provide an electric circuit breaker device including a conductor plate having a structure allowing not to cause much heat build-up upon energization and to be easily cut. Another object of the present invention is to consequently reduce the size of the electrical circuit breaker.

The present invention provides an electric circuit breaker device including a housing made of synthetic resin, a rod-like projectile made of synthetic resin and arranged in the housing, a conductor portion arranged in the housing to extend across a front face of one end portion of the rod-like projectile, and an igniter arranged in the housing to face another end portion of the rod-like projectile and configured to generate pressure to fire the rod-like projectile toward the conductor portion.

In one embodiment, the conductor portion includes a first conductor plate extending across the front face of the one end portion of the rod-like projectile and including a recess portion, and a second conductor plate coupled to the recess portion of the first conductor plate.

In another embodiment, the conductor portion includes a first conductor plate arranged on the front face of the one end portion of the rod-like projectile, and a second conductor plate and a third conductor plate coupled, at a corresponding one of edge portions of the second conductor plate and the third conductor plate, to respective opposing edge portions of the first conductor plate.

The housing may have a cylindrical space therein, the cylindrical space extending from a first end portion side of the housing toward an opposing second end portion side to a middle of the housing. The cylindrical space may have a circular cross-sectional shape at a cross section perpendicular to a central axis of the cylindrical space.

The igniter may be arranged on one end of the cylindrical space of the housing. The igniter may include an igniter body including an ignition portion with an ignition charge and conduction pins connected to the igniter. A part of the igniter body may be enclosed with resin.

A metal cylinder may be press-fit into the cylindrical space of the housing.

The rod-like projectile may be arranged slidably along the cylindrical space in the housing. The rod-like projectile may include a rod portion and an increased-diameter tip portion formed at a tip of the rod portion. The rod portion may have a circular cross-sectional shape at a cross section perpendicular to the central axis of the rod-like projectile. The rod portion may be inserted into the cylindrical space of the housing or the metal cylinder press-fit into the cylindrical space. The rod portion may have a neck portion having a reduced outer diameter at a middle portion in a longitudinal direction of the rod portion. An O-ring made of rubber or synthetic resin may be fit around the neck portion. The increased-diameter tip portion may have a square or circular cross-sectional shape at a cross section perpendicular to the central axis of the rod-like projectile. The diameter or the length of one side of the increased-diameter tip portion at the cross section may be greater than the diameter of the rod portion. The rod-like projectile may have a single striking face having a square or circular shape at a tip of the increased-diameter tip portion.

The conductor portion may be arranged to extend across a space within a specific distance, the space extending from the striking face of the one end portion of the rod-like projectile in an axial direction of the rod-like projectile. The conductor portion may be arranged to extend, in a direction perpendicular to the axial direction of the rod-like projectile, across the space within the specific distance, the space extending from the striking face of the one end portion of the rod-like projectile in the axial direction of the rod-like projectile. The conductor portion may be arranged in a way that a surface of the conductor portion is perpendicular to a firing direction of the rod-like projectile. The conductor portion may be arranged in a way that the surface of the conductor portion is perpendicular to the axial direction of the rod-like projectile. The conductor portion may be arranged in a way that the surface of the conductor portion is slightly angled with respect to a direction perpendicular to the firing direction of the rod-like projectile. The conductor portion may be connected in series with an external electric circuit. The conductor portion may further include a lead terminal portion formed of a conductor plate for connecting to an external electric circuit.

The conductor portion may be connected in series with an external electric circuit.

The igniter may be energized by an external power source connected to the conductive pin, burn the ignition charge in the igniter, and thereby generate a combustion product such as combustion gas or flame in the cylindrical space. With pressure of the combustion product generated in the cylindrical space, the rod-like projectile may be fired from an end portion of the cylindrical space toward the conductor portion.

The electric circuit breaker device may further include a stopper made of an insulating material. The stopper may be configured to receive a cut piece generated when the conductor portion is cut. The stopper may include a recess portion opening toward the conductor portion. The one end of the rod-like projectile may be configured to enter, after cutting the conductor portion, an inside of the recess portion of the stopper to contain the cut piece of the conductor portion in the recess portion of the stopper. The stopper may have a box shape.

The electric circuit breaker device may further include a metal frame for reinforcing the housing. The metal frame may be formed of a curved metal plate having a U shape with cutout portions at positions where the conductor portion passes.

In one embodiment, the conductor portion may include a first conductor plate extending across the front face of the one end portion of the rod-like projectile and including a recess portion, and a second conductor plate coupled to the recess portion of the first conductor plate. The conductor portion may have a uniform thickness. The recess portion of the first conductor plate may be arranged on the front face of the one end of the rod-like projectile. The first conductor plate may include a groove, and the second conductor plate may include a ridge portion mated with the groove of the first conductor plate. In one example, the second conductor plate may be welded to the first conductor plate at a central part of one surface of the second conductor plate. In another example, the second conductor plate may be welded to the first conductor plate at a plurality of positions along an edge portion of the one surface of the second conductor plate. The number of welding positions may be two or more. The number of welding positions may be eight or less. The number of welding positions may be six or less. The number of welding positions may be four or less. The rod-like projectile may be configured to cut, upon impinging on an upper surface of the second conductor plate of the conductor portion, the second conductor plate and part of the first conductor plate corresponding to the second conductor plate from the remaining part of the first conductor plate.

In another embodiment, the conductor portion may include a first conductor plate extending across the front face of the one end portion of the rod-like projectile and including a recess portion, and a second conductor plate coupled to the recess portion of the first conductor plate. The conductor portion may have a uniform thickness. The recess portion of the first conductor plate may be arranged on the front face of the one end of the rod-like projectile. The first conductor plate may include a groove, and the second conductor plate may include a ridge portion press-fit into the groove of the first conductor plate. The groove may be slightly tapered toward an open end of the groove, and the ridge portion may be slightly tapered in reverse to be wider toward a tip of the ridge portion. The rod-like projectile may be configured to cut, upon impinging on the upper surface of the second conductor plate of the conductor portion, the second conductor plate and part of the first conductor plate corresponding to the second conductor plate from the remaining part of the first conductor plate.

In yet another embodiment, the conductor portion may include a first conductor plate arranged on the front face of the one end portion of the rod-like projectile, and a second conductor plate and a third conductor plate coupled, at a corresponding edge portions of the second conductor plate and the third conductor plate, to respective opposing edge portions of the first conductor plate. The conductor portion may have a uniform thickness. The first conductor plate and each of the second conductor plate and the third conductor plate may be arranged to slightly overlap each other at a corresponding one of the edge portions of the second conductor plate and the third conductor plate and welded together at overlapping portions between the first conductor plate and a corresponding one of the second conductor plate and the third conductor plate. The number of welding positions may be two or more. The number of welding positions may be eight or less. The number of welding positions may be six or less. The number of welding positions may be four or less. The rod-like projectile may be configured to cut, upon impinging on the upper surface of the first conductor plate of the conductor portion, the first conductor plate apart from the second conductor plate and the third conductor plate at the welding position(s).

In yet another embodiment, the conductor portion may include a first conductor plate arranged on the front face of the one end portion of the rod-like projectile, and a second conductor plate and a third conductor plate coupled, at a corresponding edge portions of the second conductor plate and the third conductor plate, to respective opposing edge portions of the first conductor plate. The first conductor plate, the second conductor plate, and the third conductor plate may have the same thickness. In one example, the first conductor plate may include a groove or a ridge portion formed in or on each of upper surfaces of the opposing edge portions, and each of the second conductor plate and the second conductor plate may include a corresponding ridge portion or a corresponding groove formed on or in a lower surface of a corresponding one of the edge portions of the second conductor plate and the second conductor plate. The first conductor plate and each of the second conductor plate and the third conductor plate may be arranged to overlap each other at edge portions of the first conductor plate and a corresponding one of the second conductor plate and the third conductor plate. Each of the grooves or the ridge portions of the first conductor plate and the ridge portion or the groove of a corresponding one of the second conductor plate and the third conductor plate may be press-fit into each other. In another example, the first conductor plate may include a groove or a ridge portion formed in or on each of side surfaces of the opposing edge portions, and each of the second conductor plate and the second conductor plate may include a corresponding ridge portion or a corresponding groove formed on or in a side surface of a corresponding one of the edge portions of the second conductor plate and the third conductor plate. The first conductor plate and each of the second conductor plate and the third conductor plate may be arranged to be flush with each other at the edge portions of the first conductor plate and a corresponding one of the second conductor plate and the third conductor plate in a manner of butting against each other. Each of the grooves or the ridge portions of the first conductor plate and the ridge portion or the groove of a corresponding one of the second conductor plate and the third conductor plate may be press-fit into each other. The rod-like projectile may be configured to cut, upon impinging on the upper surface of the first conductor plate of the conductor portion, the first conductor plate apart from the second conductor plate and the third conductor plate at the press-fit positions.

In yet another embodiment, the conductor portion may include a first conductor plate arranged on the front face of the one end portion of the rod-like projectile, and a second conductor plate and a third conductor plate coupled, at a corresponding one of edge portions of the second conductor plate and the third conductor plate, to respective opposing edge portions of the first conductor plate. The first conductor plate may include upper folding-back portions at the respective opposing edge portions, and each of the second conductor plate and the third conductor plate may include a lower folding-back portion at the edge portion of the second conductor plate and the third conductor plate. The lower folding-back portion of each of the second conductor plate and the third conductor plate may be engaged and swaged with a corresponding one of the upper folding-back portions of the first conductor plate. The rod-like projectile may be configured to cut, upon impinging on the upper surface of the first conductor plate of the conductor portion, the first conductor plate apart from the second conductor plate and the third conductor plate at the swaging positions.

EMBODIMENTS OF THE INVENTION

Next, an embodiment of the present invention will be described in more detail with reference to the drawings.

FIG. 1 is an exploded perspective view of an electric circuit breaker device according to one embodiment of the present invention. The electric circuit breaker device includes a housing 10 made of synthetic resin, an igniter 20 arranged in the housing 10, a metal cylinder 30, a rod-like projectile 40 made of synthetic resin, a conductor portion 50, and a stopper 60 made of an insulating material. The metal cylinder 30 is attached to the housing 10 through an opening formed in a bottom portion of the housing 10. The igniter 20 and the rod-like projectile 40 are inserted into the metal cylinder 30 through the opening formed in the bottom portion of the housing 10. The conductor portion 50 and the stopper 60 are attached to a front face of the housing 10.

Figure 2:
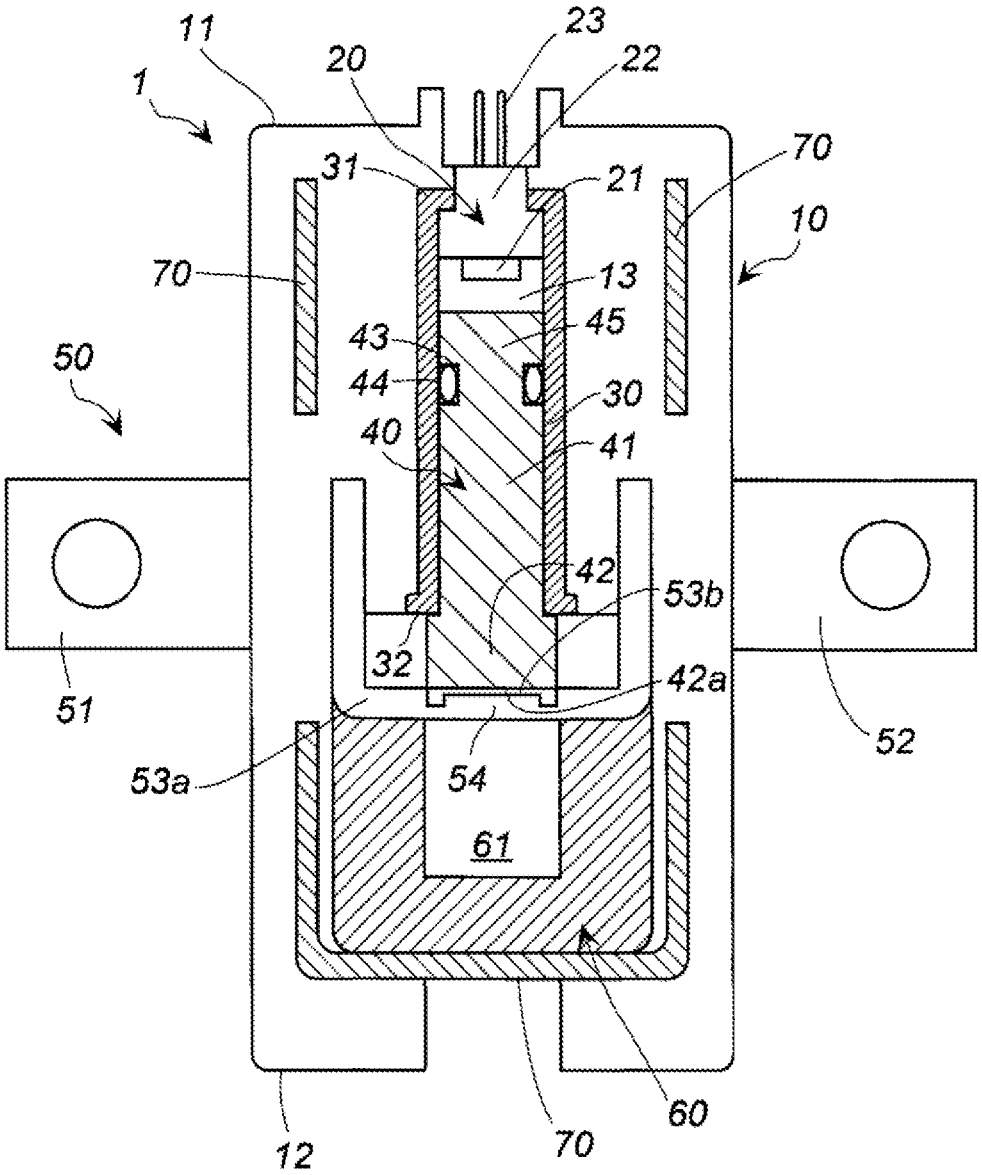
FIG. 2 is a cross-sectional view illustrating an electric circuit breaker device according to one embodiment of the present invention.

FIG. 2 is a cross-sectional view of an electric circuit breaker device 1 formed by assembling the components illustrated in FIG. 1, the cross-sectional view being obtained when the electric circuit breaker device 1 is viewed along the Y-Z plane at an x-axis central position thereof.

The housing 10 has a cylindrical space 13 therein, the cylindrical space 13 extending from a first end portion 11 side of the housing 10 toward an opposing second end portion 12 side to a middle of the housing 10. The cylindrical space 13 has a circular cross-sectional shape at a cross section perpendicular to the central axis of the cylindrical space 13. The external shape of the housing 10 may be appropriately determined according to a shape of a portion to which the electric circuit breaker device 1 is to be attached.

At one end of the cylindrical space 13, the igniter 20 is arranged in close proximity to a tip-end portion 45 of the rod-like projectile 40 to face the tip-end portion 45 and generates pressure to fire the rod-like projectile 40 toward the conductor portion 50. The igniter 20 includes an igniter body 22 including an ignition portion 21 with an ignition charge and conduction pins 23 connected to the ignition portion 21. A part 22 of the igniter body 22 is enclosed with resin.

The metal cylinder 30 is arranged in the cylindrical space 13 of the housing 10 by press-fitting or the like. However, the metal cylinder 30 is for reinforcing the housing 10 and may be omitted if the housing 10 has sufficient strength.

The rod-like projectile 40 is arranged slidably along the cylindrical space 13 in the housing 10. The rod-like projectile 40 includes a rod portion 41 and an increased-diameter tip portion 42 formed at a tip of the rod portion 41. The rod portion 41 has a circular cross-sectional shape at a cross section perpendicular to the central axis of the rod-like projectile 40. The rod portion 41 is inserted into the cylindrical space 13 of the housing 10 or the metal cylinder 30 arranged in the cylindrical space 13. The rod portion 41 may have a neck portion 43 having a reduced outer diameter at a middle portion in longitudinal direction of the rod portion 41. For sealing, an O-ring 44 made of rubber (for example, silicone rubber) or synthetic resin may be fit into the neck portion 43. The increased-diameter tip portion 42 has a square or circular cross-sectional shape at a cross section perpendicular to the central axis of the rod-like projectile 40. The diameter or the length of one side of the increased-diameter tip portion 42 at the cross section is greater than the diameter of the rod portion 41. The rod-like projectile 40 has a single square or circular striking face 42*a* at a tip of the increasing-diameter tip portion 42. The striking face 42*a* is preferably square. The striking face 42*a* is preferably flat. However, the striking face 42*a* may have some unevenness within a range in which the effects of the present invention can be obtained. In one example, the striking face 42*a* is perpendicular to a firing direction of the rod-like projectile 40 (i.e., the axial direction of the rod-like projectile 40).

The conductor portion 50 is arranged to extend across a front face of one end portion (i.e., the increasing-diameter tip portion) 42 of the rod-like projectile 40 (i.e., a space within a specific distance, the space extending from the striking face 42*a* of the one end portion 42 of the rod-like projectile 40 in the axial direction of the rod-like projectile 40). This specific distance may be equal to a movable distance (refer to FIG. 3) of the rod-like projectile 40 and may be defined as a distance from the striking face 42*a* to a bottom surface of a recess portion 61 of the stopper 60 to be described later. The conductor portion 50 is preferably arranged to extend across the front face of the end portion 42 of the rod-like projectile 40 in a direction perpendicular to the firing direction of the rod-like projectile 40 (i.e., the axial direction of the rod-like projectile 40). The conductor portion 50 is preferably arranged in a way that a surface of the conductor portion 50 is perpendicular to the firing direction of the rod-like projectile 40 (i.e., the axial direction of the rod-like projectile 40). However, the conductor portion 50 may be arranged in a way that the surface of the conductor portion 50 is slightly angled with respect to a direction perpendicular to the firing direction of the rod-like projectile 40, within a range in which the conductor portion 50 can be cut by the rod-like projectile 40. In the example in FIG. 2, the conductor portion 50 is curved to have a U shape in the housing 10, but the conductor portion 50 need not necessarily be curved. In another example, the conductor portion 50 may be formed by a flat conductor plate. The conductor portion 50 is connected in series with an external electric circuit (not illustrated) when the electric circuit breaker device 1 is in use, and functions to cut the external electric circuit when the device 1 is in operation. The conductor portion 50 further includes lead terminal portions 51 and 52 formed by respective conductor plates for connecting to the external electric circuit (not illustrated). Each of the illustrated lead terminal portions 51 and 52 is formed of a curved conductor plate for convenience of attachment to the housing 10, but the shape of the lead terminal portions 51 and 52 is not limited to such a curved shape. In another example, each of the lead terminal portions 51 and 52 may be formed by a flat conductor plate. Details of the conductor portion 50 will be described later with reference to FIG. 4 to FIG. 9.

When an abnormality occurs in the external electric circuit, the igniter 20 is energized by an external power source (not illustrated) connected to the conduction pins 23, burns the ignition charge in the ignition portion 21, and thereby generates a combustion product such as combustion gas or flame in the cylindrical space 13. With pressure of the combustion product generated in the cylindrical space 13, the rod-like projectile 40 is fired from an end portion of the cylindrical space 13 toward the conductor portion 50. The end portion 42 of the rod-like projectile 40 thus fired collides with the conductor portion 50 and thereby cuts the conductor portion 50 as illustrated in FIG. 3.

The stopper 60 functions to receive a cut piece generated when the conductor portion 50 is cut. The stopper 60 is made of an insulating material and includes a recess portion 61 opening toward the conductor portion 50. The end portion 42 of the rod-like projectile 40 enters, after cutting the conductor portion 50, an inside of the recess portion 61 of the stopper 60 to contain the cut piece of the conductor portion 50 in the recess portion 61 of the stopper 60. This prevents any occurrence of unintended short circuit and/or arcing due to the cut piece. In one example, the stopper 60 has a box shape. However, the outer shape of the stopper 60 may be appropriately changed according to the shape of the attachment portion.

The electric circuit breaker device 1 may further include a metal frame 70 for reinforcing the housing 10. In one example, the metal frame 70 is formed of a curved metal plate having a U shape with cutout portions at positions where the conductor portion 50 passes. However, the shape of the metal frame 70 may be appropriately changed within a range in which the strength of the housing 10 can be improved without interfering with the function of the other components of the device 1. The metal frame 70 may be omitted if the housing 10 has sufficient strength.

Figure 3:
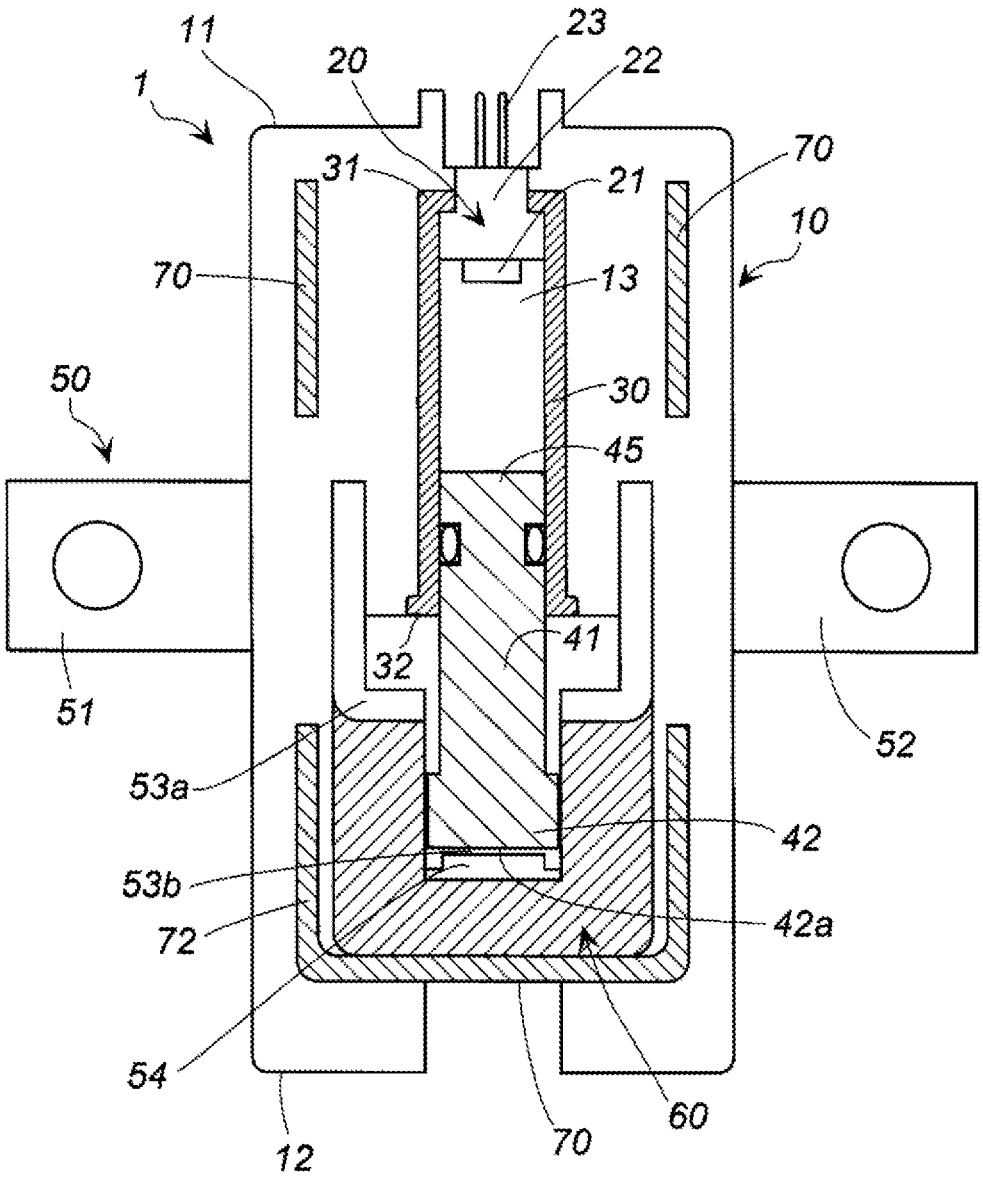
FIG. 3 is a cross-sectional view illustrating a state after actuation of an electric circuit breaker device according to one embodiment of the present invention.
Figure 4A:
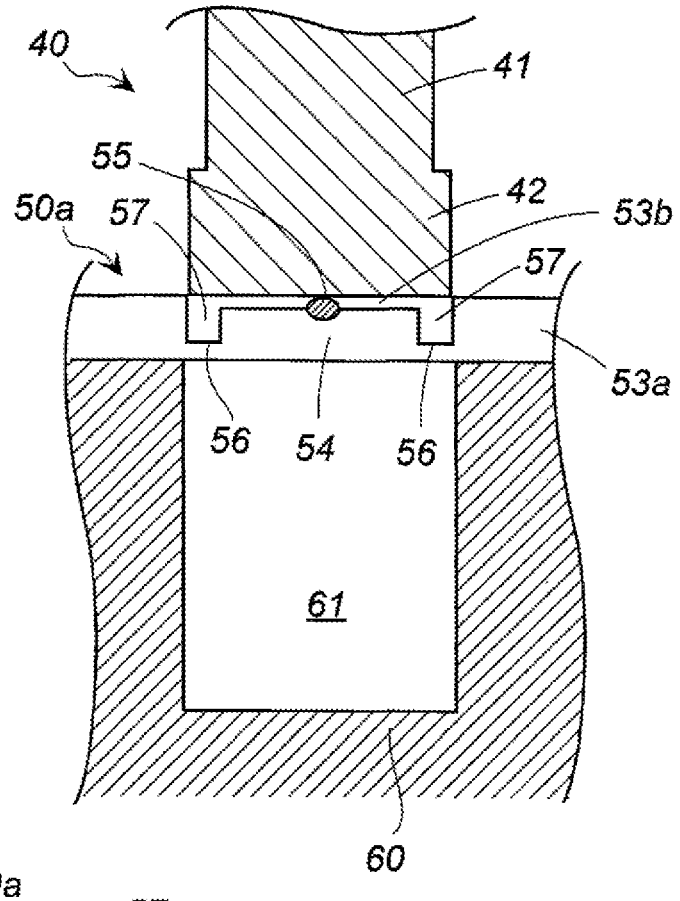
FIG. 4A is a partial cross-sectional view illustrating a relationship with peripheral components in an engagement section of a conductor portion according to a first embodiment.
Figure 4B:
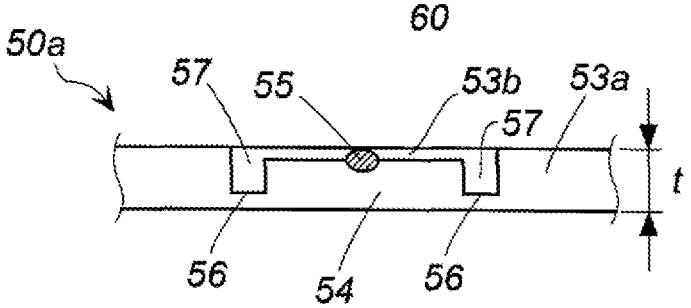
FIG. 4B is a partial cross-sectional view and FIG. 4C is a partial plan view of the engagement section.
Figure 4C:
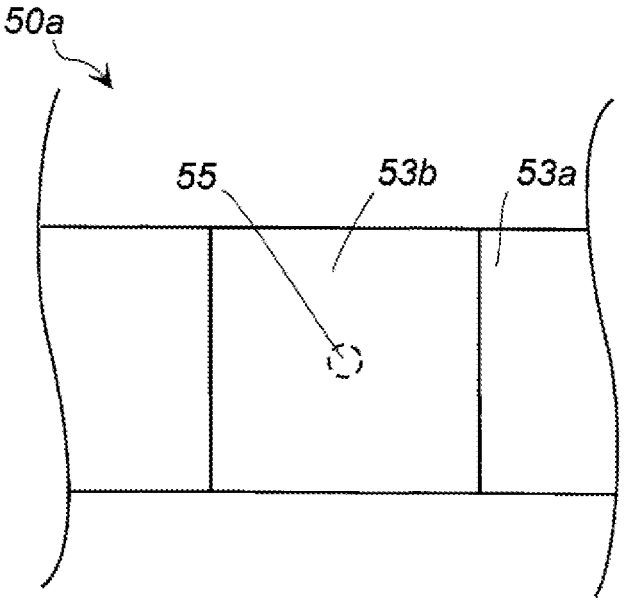

FIG. 4 illustrates part of a conductor portion 50*a* according to a first embodiment of the conductor portion 50 illustrated in FIG. 1 to FIG. 3. The remaining part is structured similarly to the conductor portion 50 illustrated in FIG. 1 to FIG. 3. The conductor portion 50*a* includes a first conductor plate 53*a* extending across the front face of the end portion 42 of the rod-like projectile 40 and including a recess portion 54 (including two grooves 56 and a thin portion formed between the grooves 56), and a second conductor plate 53*b* coupled to the recess portion 54 of the first conductor plate 53*a*. The second conductor plate 53*b* functions to supplement the thickness of the recess portion 54 of the first conductor plate 53*a*. In one example, the conductor portion 50*a* has a uniform thickness t. In another example, the conductor portion 50*a* has a non-uniform thickness. The recess portion 54 of the first conductor plate 53*a* and the second conductor plate 53*b* are arranged on the front face of the end portion 42 of the rod-like projectile 40. The first conductor plate 53*a* includes two grooves 56 for facilitating cutting of the conductor portion 50*a*, and the second conductor plate 53*b* includes two ridge portions 57 mated with the two respective grooves 56 of the first conductor plate 53*a*. The two grooves 56 of the first conductor plate 53*a* are formed at the positions corresponding to edge portions of the striking face 42*a* of the end portion 42 of the rod-like projectile 40. The second conductor plate 53*b* is coupled to the recess portion 54 of the first conductor plate 53*a* by mating the ridge portions 57 with the respective grooves 56, and is spot-welded to the first conductor plate 53*a* at a single central portion 55 of a lower surface of the second conductor plate 53*b*. The end portion 42 of the rod-like projectile 40 cuts, upon impinging on an upper surface of the conductor portion 50*a*, the second conductor plate 53*b* and part of the first conductor plate 53*a* corresponding to the second conductor plate 53*b* from the remaining part of the first conductor plate 53*a*. In this example, the recess portion 54 of the first conductor plate 53*a* is formed on an upper side of the first conductor plate 53*a*, and the second conductor plate 53*b* is coupled to the upper side of the first conductor plate 53*a*, but an upside-down structure is also possible.

Figure 5A:
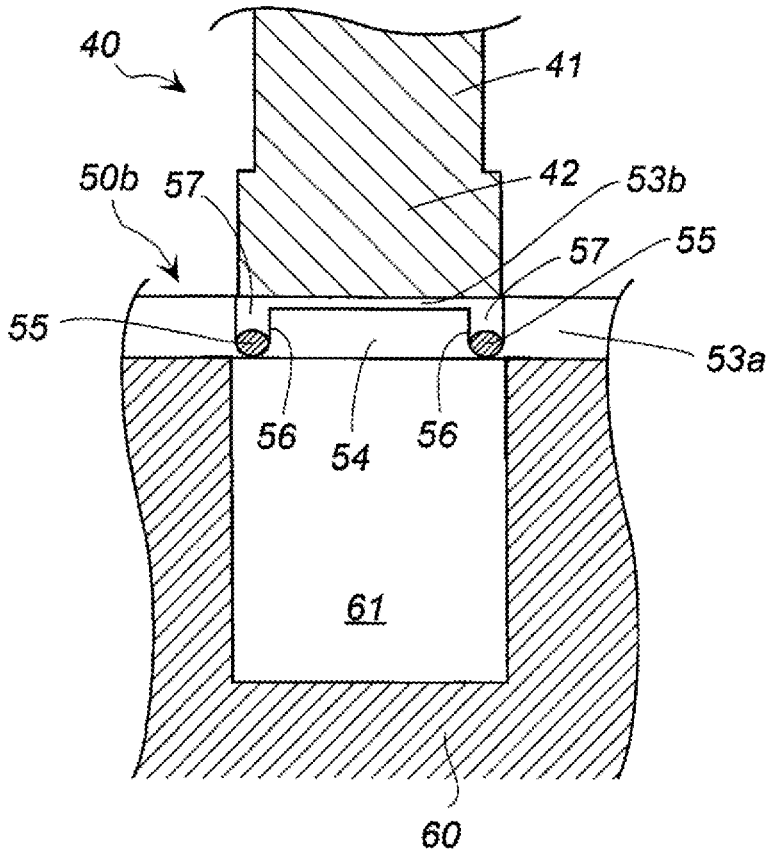
FIG. 5A is a partial cross-sectional view illustrating a relationship with peripheral components in an engagement section of a conductor portion according to a second embodiment.
Figure 5B:
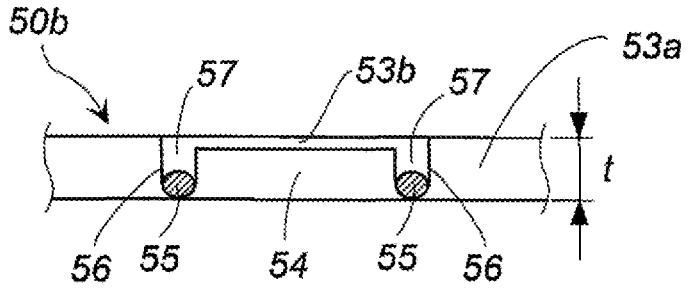
FIG. 5B is a partial cross-sectional view and FIG. 5C is a partial plan view of the engagement section.
Figure 5C:
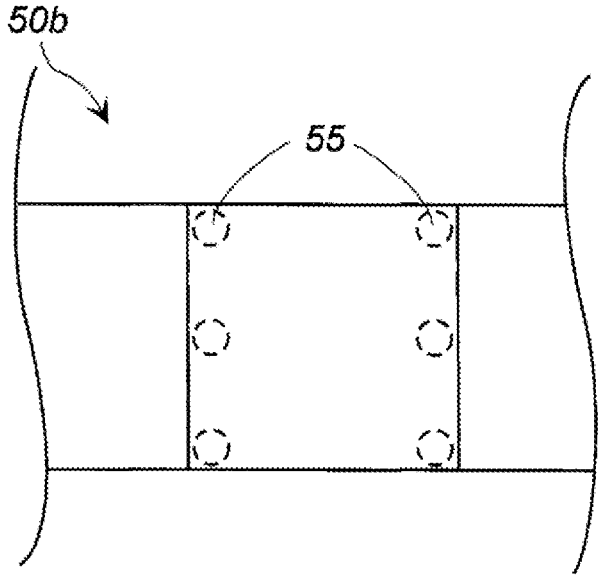

FIG. 5 illustrates part of a conductor portion 50*b* according to a second embodiment of the present invention. The remaining part is structured similarly to the conductor portion 50 illustrated in FIG. 1 to FIG. 3. The conductor portion 50*b* includes a first conductor plate 53*a* extending across the front face of the end portion 42 of the rod-like projectile 40 and including a recess portion 54 (including two grooves 56 and a thin portion formed between the grooves 56), and a second conductor plate 53*b* coupled to the recess portion 54 of the first conductor plate 53*a*. The second conductor plate 53*b* functions to supplement the thickness of the recess portion 54 of the first conductor plate 53*a*. In one example, the conductor portion 50*b* has a uniform thickness t. In another example, the conductor portion 50*b* has a non-uniform thickness. The recess portion 54 of the first conductor plate 53*a* and the second conductor plate 53*b* are arranged on the front face of the end portion 42 of the rod-like projectile 40. The first conductor plate 53*a* includes the two grooves 56 for facilitating cutting of the conductor portion 50*b*, and the second conductor plate 53*b* includes two ridge portions 57 mated with the two respective grooves 56 of the first conductor plate 53*a*. The two grooves 56 of the first conductor plate 53*a* are formed at the positions corresponding to edge portions of the striking face 42*a* of the end portion 42 of the rod-like projectile 40. The second conductor plate 53*b* is coupled to the recess portion 54 of the first conductor plate 53*a* by mating the ridge portions 57 with the respective grooves 56, and is spot-welded to the first conductor plate 53*a* at six positions 55 along edge portions of a lower surface of the second conductor plate 53*b*. Specifically, the second conductor plate 53*b* is spot-welded, at tip portions of the ridge portions 57, to bottoms of the grooves 56 of the first conductor plate 53*a*. The number of welding positions is not limited to the illustrated six positions. In order to ensure stable energization, the number of welding positions is preferably two or greater. In order to facilitate cutting, the number of welding positions is preferably eight or less. In one example, the number of welding positions is six or less. In another example, the number of welding positions is four or less. The end portion 42 of the rod-like projectile 40 cuts, upon impinging on an upper surface of the conductor portion 50*b*, the second conductor plate 53*b* and part of the first conductor plate 53*a* corresponding to the second conductor plate 53*b* from the remaining part of the first conductor plate 53*a*. In this example, the recess portion 54 is formed on an upper side of the first conductor plate 53*a*, and the second conductor plate 53*b* is coupled to the upper side of the first conductor plate 53*a*, but an upside-down structure is also possible.

Figure 6A:
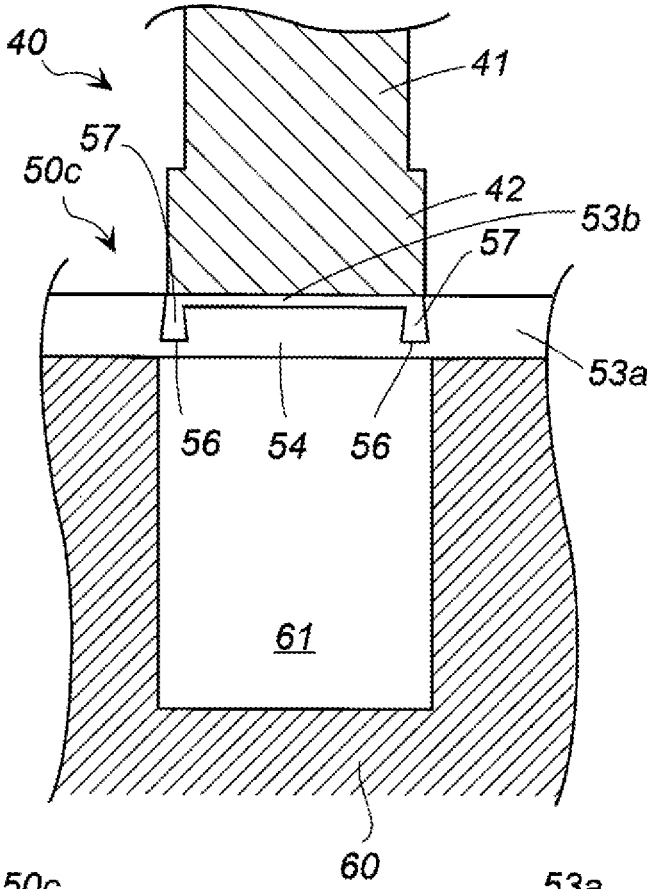
FIG. 6A is a partial cross-sectional view illustrating a relationship with peripheral components in an engagement section of a conductor portion according to a third embodiment.
Figure 6B:
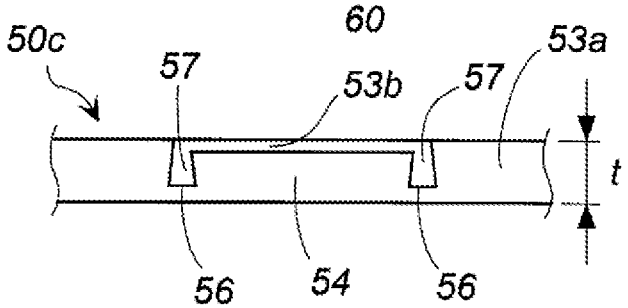
FIG. 6B is a partial cross-sectional view and FIG. 6C is a partial plan view of the engagement section.
Figure 6C:
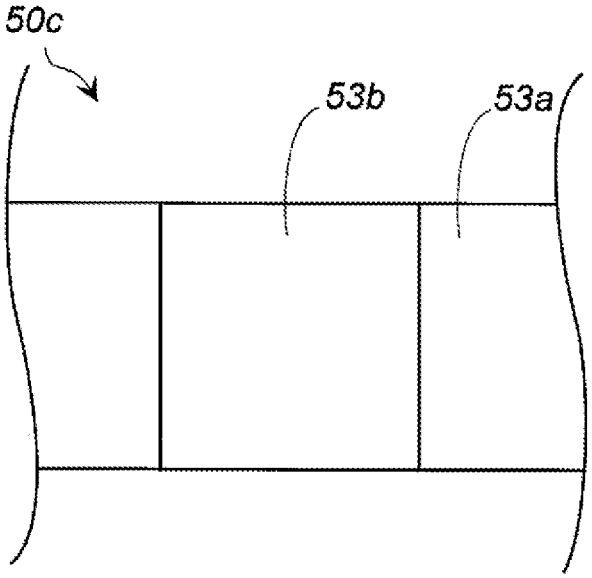

FIG. 6 illustrates part of a conductor portion 50*c* according to a third embodiment of the present invention. The remaining part is structured similarly to the conductor portion 50 illustrated in FIG. 1 to FIG. 3. The conductor portion 50*c* includes a first conductor plate 53*a* extending across the front face of the end portion 42 of the rod-like projectile 40 and including a recess portion 54 (including two grooves 56 and a thin portion formed between the grooves 56), and a second conductor plate 53*b* coupled to the recess portion 54 of the first conductor plate 53*a*. The second conductor plate 53*b* functions to supplement the thickness of the recess portion 54 of the first conductor plate 53*a*. In one example, the conductor portion 50*c* has a uniform thickness t. In another example, the conductor portion 50*c* has a non-uniform thickness. The recess portion 54 of the first conductor plate 53*a* and the second conductor plate 53*b* are arranged on the front face of the end portion 42 of the rod-like projectile 40. The first conductor plate 53*a* includes the two grooves 56 for facilitating cutting of the conductor portion 50*c*, and the second conductor plate 53*b* includes two ridge portions 57 fit into the two respective grooves 56 of the first conductor plate 53*a*. The two grooves 56 of the first conductor plate 53*a* are formed at the positions corresponding to the respective edge portions of the striking face 42*a* of the end portion 42 of the rod-like projectile 40. Each of the grooves 56 is slightly tapered toward a corresponding open end of the grooves 56, and each of the ridge portions 57 is slightly tapered in reverse to be wider toward a corresponding tip of the ridge portions 57. In the drawing, the tapers are illustrated in an emphasized manner for clarity. The second conductor plate 53*b* is coupled to the recess portion 54 of the first conductor plate 53*a* by press-fitting the ridge portions 57 into the respective grooves 56. The end portion 42 of the rod-like projectile 40 cuts, upon impinging on an upper surface of the conductor portion 50*c*, the second conductor plate 53*b* and part of the first conductor plate 53*a* corresponding to the second conductor plate 53*b* from the remaining part of the first conductor plate 53*a*. In this example, the recess portion 54 is formed on an upper side of the first conductor plate 53*a*, and the second conductor plate 53*b* is coupled to the upper side of the first conductor plate 53*a*, but an upside-down structure is also possible.

Figure 7A:
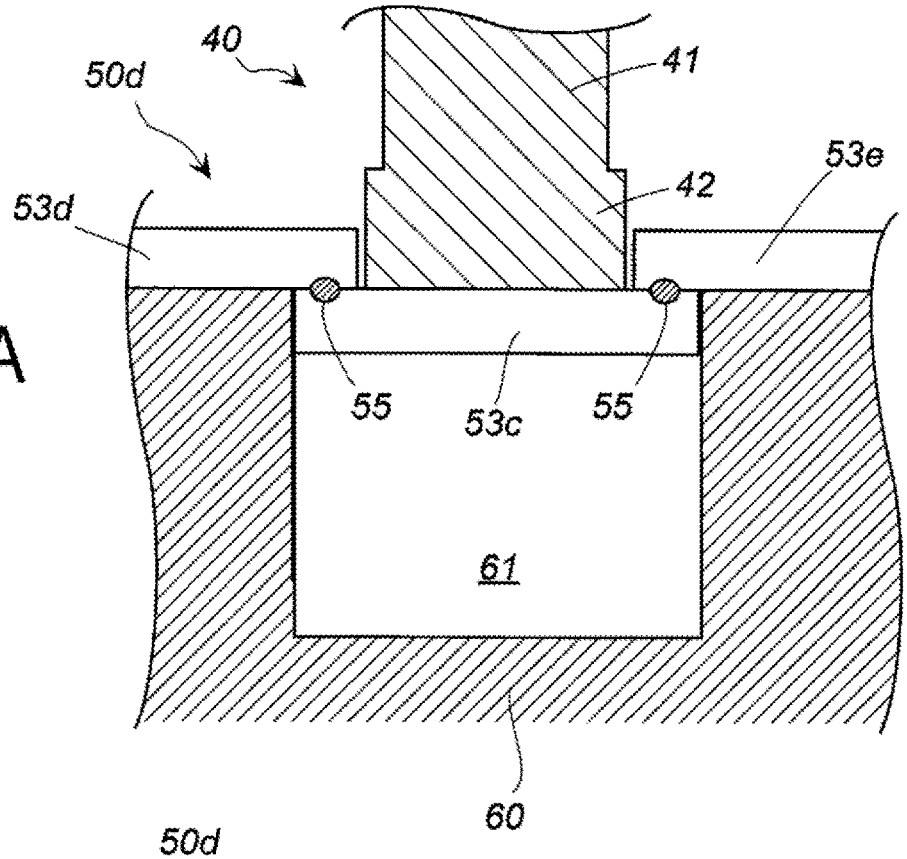
FIG. 7A is a partial cross-sectional view illustrating a relationship with peripheral components in an engagement section of a conductor portion according to a fourth embodiment.
Figure 7B:
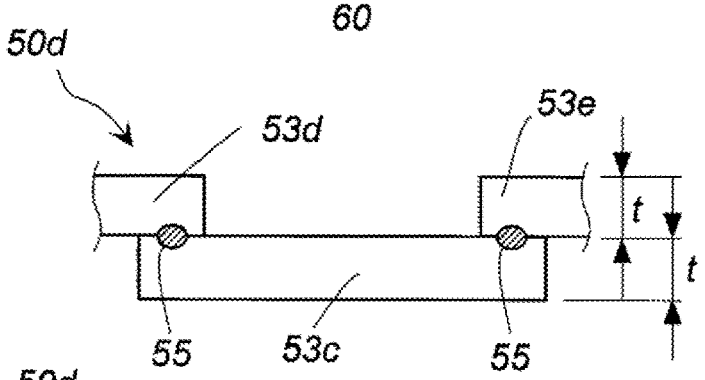
FIG. 7B is a partial cross-sectional view and FIG. 7C is a partial plan view of the engagement section.
Figure 7C:
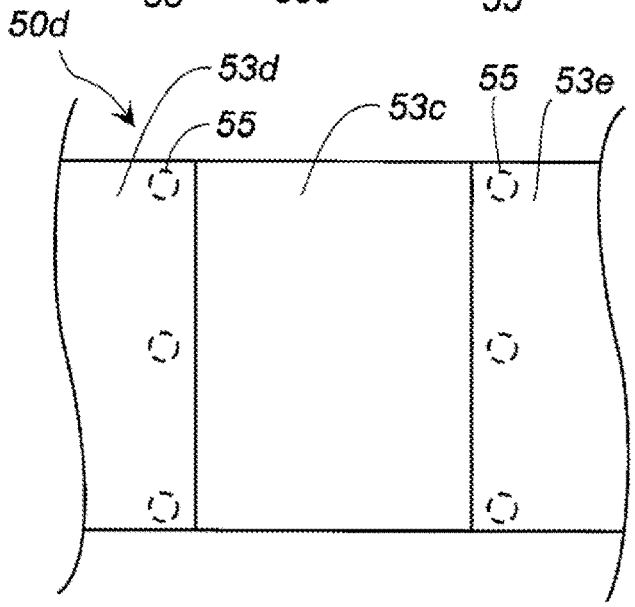

FIG. 7 illustrates part of a conductor portion 50*d* according to a fourth embodiment of the present invention. The remaining part is structured similarly to the conductor portion 50 illustrated in FIG. 1 to FIG. 3. The conductor portion 50*d* includes a first conductor plate 53*c* arranged on the front face of the end portion 42 of the rod-like projectile 40, and a second conductor plate 53*d* and a third conductor plate 53*e* coupled, at a corresponding one of edge portions of the second conductor plate 53*d* and the third conductor plate 53*e*, to respective opposing edge portions of the first conductor plate 53*c*. In other words, a conductor portion 50*d* includes the second conductor plate 53*d* and the third conductor plate 53*e* arranged to be flush with each other with a space from one another, and the first conductor plate 53*c* coupling the second conductor plate 53*d* and the third conductor plate 53*e* with each other and arranged on the front face of the end portion 42 of the rod-like projectile 40. In one example, the conductor plates 53*c*, 53*d*, and 53*e* have the same thickness t. In another example, the conductor plates 53*c*, 53*d*, and 53*e* have different thicknesses. The first conductor plate 53*c* and each of the second conductor plate 53*d* and the third conductor plate 53*e* are arranged to slightly overlap each other at edge portions of the first conductor plate 53*c* and a corresponding one of the second conductor plate 53*d* and the third conductor plate 53*e* and welded together at overlapping portions between the first conductor plate and a corresponding one of the second conductor plate and the third conductor plate, at six positions 55 in total. The number of welding positions is not limited to the illustrated six positions. In order to ensure stable energization, the number of welding positions is preferably two or greater. In order to facilitate cutting, the number of welding positions is preferably eight or less. In one example, the number of welding positions is six or less. In another example, the number of welding positions is four or less. The end portion 42 of the rod-like projectile 40 cuts, upon impinging on an upper surface of the conductor portion 50*d*, the second conductor plate 53*d* and the third conductor plate 53*e* apart from the first conductor plate 53*c* at the welding position(s).

Figure 8A:
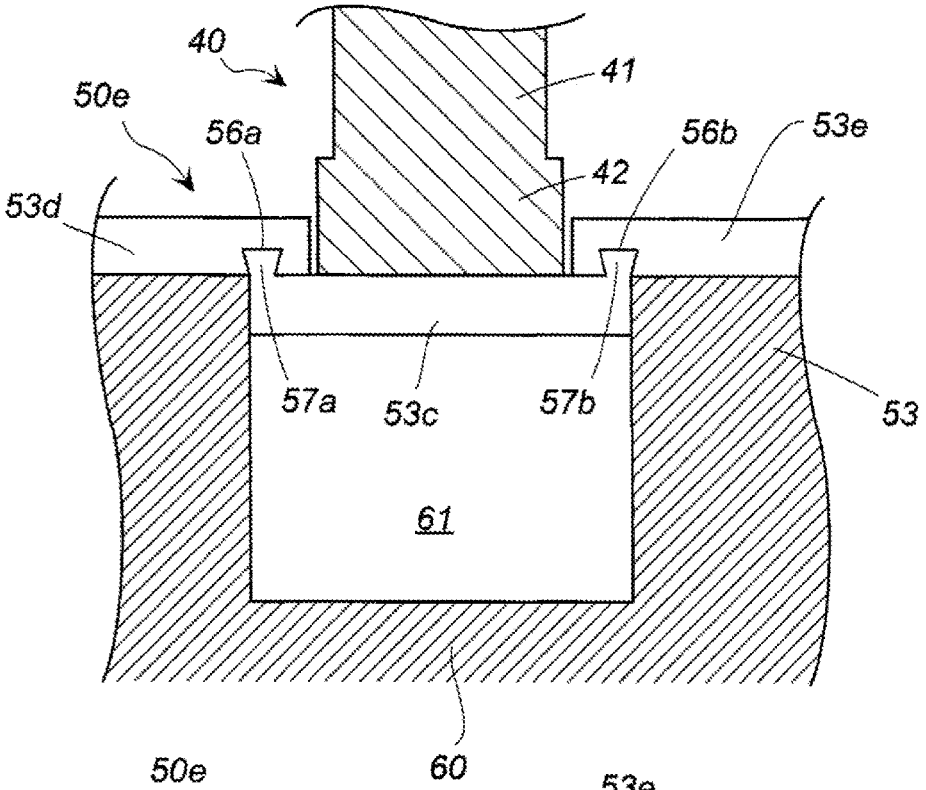
FIG. 8A is a partial cross-sectional view illustrating a relationship with peripheral components in an engagement section of a conductor portion according to a fifth embodiment.
Figure 8B:
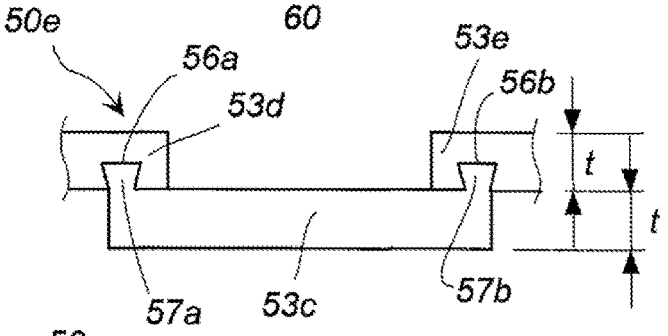
FIG. 8B is a partial cross-sectional view and FIG. 8C is a partial plan view of the engagement section.
Figure 8C:
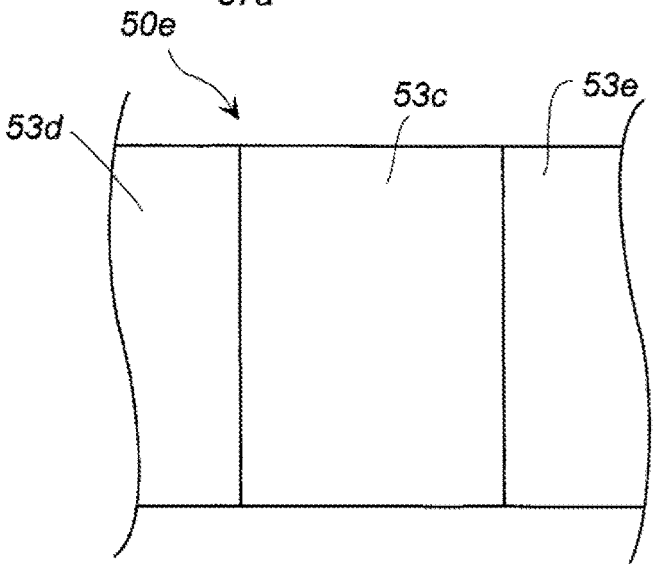

FIG. 8 illustrates part of a conductor portion 50*e* according to a fifth embodiment of the present invention. The remaining part is structured similarly to the conductor portion 50 illustrated in FIG. 1 to FIG. 3. The conductor portion 50*e* includes a first conductor plate 53*c* arranged on the front face of the end portion 42 of the rod-like projectile 40, and a second conductor plate 53*d* and a third conductor plate 53*e* coupled, at a corresponding one of edge portions of the second conductor plate 53*d* and the third conductor plate 53*e*, to respective opposing edge portions of the first conductor plate 53*c*. In other words, the conductor portion 50*e* includes the second conductor plate 53*d* and the third conductor plate 53*e* arranged to be flush with each other with a space from one another, and the first conductor plate 53*c* connecting the second conductor plate 53*d* and the third conductor plate 53*e* with each other and arranged on the front face of the end portion 42 of the rod-like projectile 40. In one example, the conductor plates 53*c*, 53*d*, and 53*e* have the same thickness t. In another example, the conductor plates 53*c*, 53*d*, and 53*e* have different thicknesses. The first conductor plate 53*c* includes ridge portions 57*a* and 57*b* formed on respective upper surfaces of opposing edge portions of the first conductor plate 53*c*, the second conductor plate 53*d* includes a corresponding groove 56*a* formed in a lower surface of an edge portion of the second conductor plate 53*d*, and the third conductor plate 53*e* includes a corresponding groove 56*b* formed in a lower surface of an edge portion of the third conductor plate 53*e*. Each of the grooves 56*a* and 56*b* is slightly tapered toward an open end of the corresponding one of the grooves 56*a* and 56*b*, and each of the ridge portions 57*a* and 57*b* is slightly tapered in reverse to be wider toward a tip of the corresponding one of the ridge portions 57*a* and 57*b*. In the drawing, the tapers are illustrated in an emphasized manner for clarity. The first conductor plate 53*c* and each of the second conductor plate 53*d* and the third conductor plate 53*e* are arranged to slightly overlap each other at edge portions of the first conductor plate 53*c* and a corresponding one of the second conductor plate 53*d* and the third conductor plate 53*e*. The ridge portion 57*a* of the first conductor plate 53*c* and the groove 56*a* of the second conductor plate 53*d* are press-fit into each other. The ridge portion 57*b* of the first conductor plate 53*c* and the groove 56*b* of the third conductor plate 53*e* are press-fit into each other. In other words, the first conductor plate 53*c* and each of the second conductor plate 53*d* and the third conductor plate 53*e* are arranged to slightly overlap each other at the edge portions of the first conductor plate 53*c* and a corresponding one of the second conductor plate 53*d* and the third conductor plate 53*e* and press-fit into each other at overlapping portions between the first conductor plate 53*c* and a corresponding one of the second conductor plate 53*d* and the third conductor plate 53*e* in a thickness direction. In the example in FIG. 8, the ridge portions are formed on the first conductor plate 53*c*, and the grooves are formed in the second conductor plate 53*d* and the third conductor plate 53*e*, but a reverse structure is also possible. The end portion 42 of the rod-like projectile 40 cuts, upon impinging on an upper surface of the conductor portion 50*e*, the first conductor plate 53*c* apart from the second conductor plate 53*d* and the third conductor plate 53*e* at press-fitting positions.

Figure 9A:
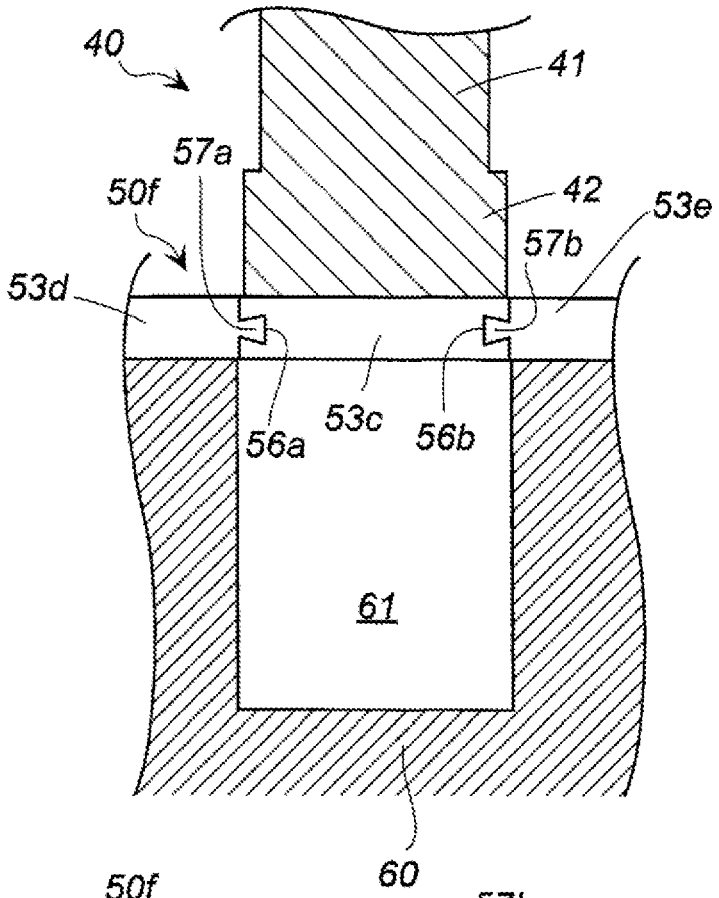
FIG. 9A is a partial cross-sectional view illustrating a relationship with peripheral components in an engagement section of a conductor portion according to a sixth embodiment.
Figure 9B:
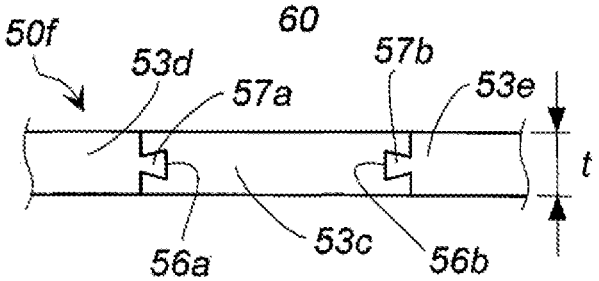
FIG. 9B is a partial cross-sectional view and FIG. 9C is a partial plan view of the engagement section.
Figure 9C:
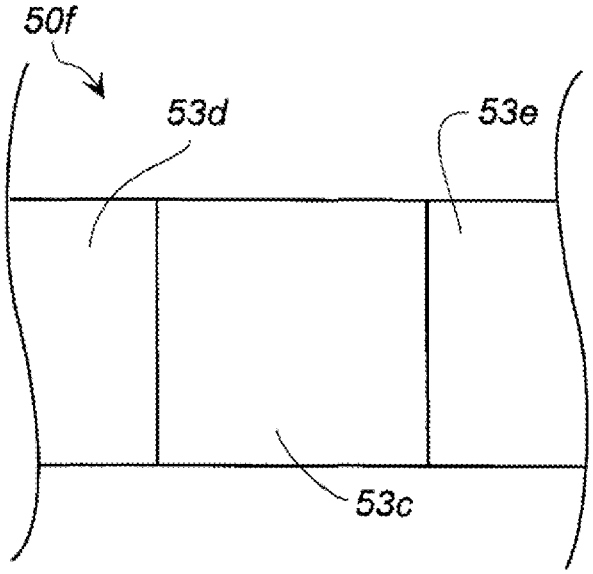

FIG. 9 illustrates part of a conductor portion 50*f* according to a sixth embodiment of the present invention. The remaining part is structured similarly to the conductor portion 50 illustrated in FIG. 1 to FIG. 3. The conductor portion 50*f* includes a first conductor plate 53*c* arranged on the front face of the end portion 42 of the rod-like projectile 40, and a second conductor plate 53*d* and a third conductor plate 53*e* coupled, at a corresponding one of edge portions of the second conductor plate 53*d* and the third conductor plate 53*e*, to respective opposing edge portions of the first conductor plate 53*c*. In other words, the conductor portion 50*f* includes the second conductor plate 53*d* and the third conductor plate 53*e* arranged to be flush with each other with a space from one another, and the first conductor plate 53*c* connecting the second conductor plate 53*d* and the third conductor plate 53*e* with each other and arranged on the front face of the end portion 42 of the rod-like projectile 40. In one example, the conductor plates 53*c*, 53*d*, and 53*e* have the same thickness t. In another example, the conductor plates 53*c*, 53*d*, and 53*e* have different thicknesses. The first conductor plate 53*c* includes grooves 56*a* and 56*b* formed in respective side surfaces of opposing edge portions of first conductor plate 53*c*, the second conductor plate 53*d* includes a corresponding ridge portion 57*a* formed on a side surface of an edge portion of the second conductor plate 53*d*, and the third conductor plate 53*e* includes a corresponding ridge portion 57*b* formed on a side surface of an edge portion of the third conductor plate 53*e*. Each of the grooves 56*a* and 56*b* is slightly tapered toward an open end of the corresponding one of the grooves 56*a* and 56*b*, and each of the ridge portions 57*a* and 57*b* is slightly tapered in reverse to be wider toward a tip of the corresponding one of the ridge portions 57*a* and 57*b*. In the drawing, the tapers are illustrated in an emphasized manner for clarity. The first conductor plate 53*c* and each of the second conductor plate 53*d* and the third conductor plate 53*e* are arranged to be flush with each other at the edge portions thereof in a manner of butting against each other. The groove 56*a* of the first conductor plate 53*c* and the ridge portion 57*a* of the second conductor plate 53*d* are press-fit into each other. The groove 56*b* of the first conductor plate 53*c* and the ridge portion 57*b* of the third conductor plate 53*e* are press-fit into each other. In other words, the first conductor plate 53*c* and each of the second conductor plate 53*d* and the third conductor plate 53*e* are arranged to be flush with each other at edge portions thereof in a manner of butting against each other and press-fit into each other in a direction parallel to surfaces of the conductor plates 53*c*, 53*d*, and 53*e*. In the example in FIG. 9, the grooves 51*a* and 56*b* are formed in the first conductor plate 53*c*, and the ridge portions 57*a* and 57*b* are formed respectively in the second conductor plate 53*d* and the third conductor plate 53*e*, but a reverse structure is also possible. The end portion 42 of the rod-like projectile 40 cuts, upon impinging on an upper surface of the conductor portion 50*f*, the first conductor plate 53*c* apart from the second conductor plate 53*d* and the third conductor plate 53*e* at press-fitting positions.

Figure 10A:
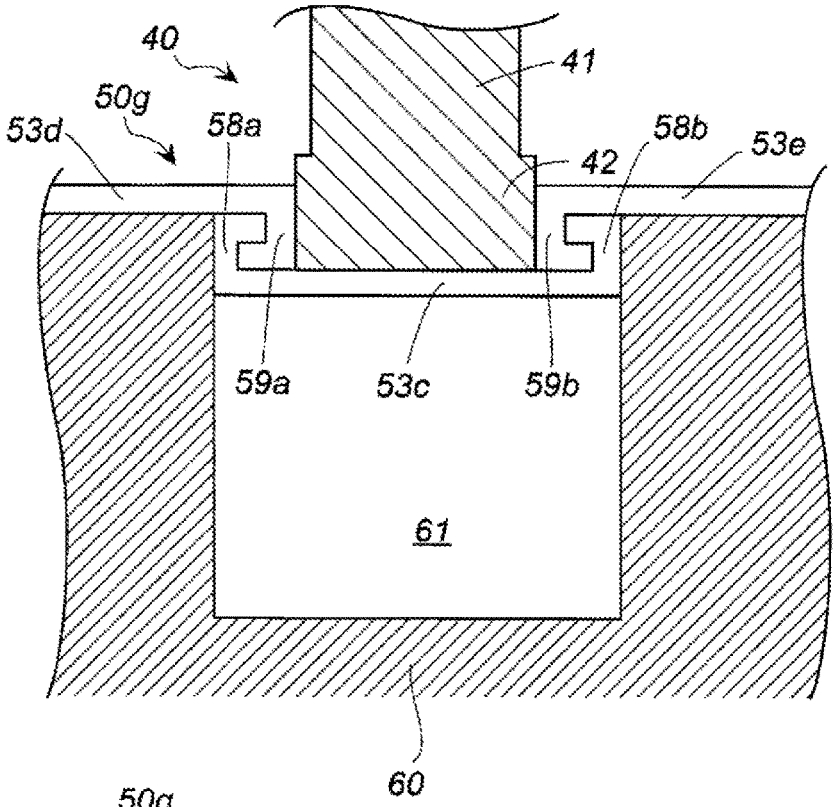
FIG. 10A is a partial cross-sectional view illustrating a relationship with peripheral components in an engagement section of a conductor portion according to a seventh embodiment.
Figure 10B:
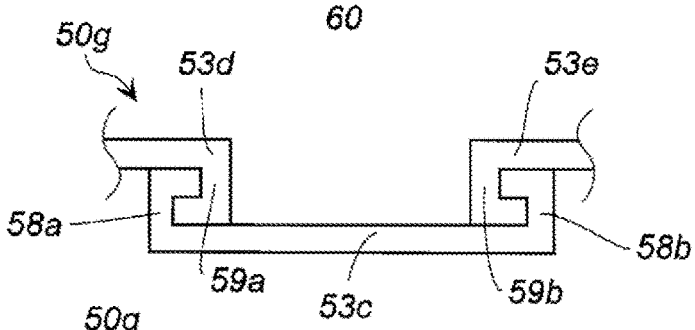
FIG. 10B is a partial cross-sectional view and FIG. 10C is a partial plan view of the engagement section.
Figure 10C:
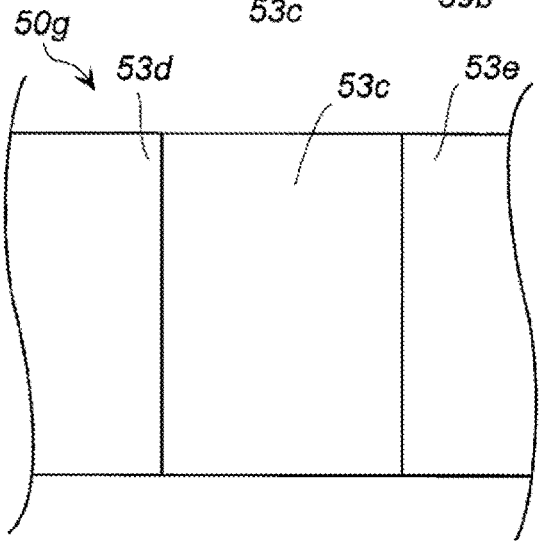

FIG. 10 illustrates part of a conductor portion 50*g* according to a seventh embodiment of the present invention. The remaining part is structured similarly to the conductor portion 50 illustrated in FIG. 1 to FIG. 3. The conductor portion 50*g* includes a first conductor plate 53*c* arranged on the front face of the end portion 42 of the rod-like projectile 40, and a second conductor plate 53*d* and a third conductor plate 53*e* coupled, at a corresponding one of edge portions of the second conductor plate 53*d* and the third conductor plate 53*e*, to respective opposing edge portions of the first conductor plate 53*c*. In other words, a conductor portion 50*g* includes the second conductor plate 53*d* and the third conductor plate 53*e* arranged to be flush with each other with a space from one another, and the first conductor plate 53*c* connecting the second conductor plate 53*d* and the third conductor plate 53*e* to each other and arranged on the front face of the end portion 42 of the rod-like projectile 40. The first conductor plate 53*c* includes upper folding-back portions 58*a* and 58*b* at the respective opposing edge portions. The second conductor plate 53*d* includes a lower folding-back portion 59*a* at an edge portion of the second conductor plate 53*d*, and the third conductor plate 53*e* includes a lower folding-back portion 59*b* at an edge portion of the third conductor plate. The lower folding-back portion 59*a* of the second conductor plate 53*d* is engaged with the upper folding-back portion 58*a* of the first conductor plate 53*c* and swaged in an up-down direction. Similarly, the lower folding-back portion 59*b* of the third conductor plate 53*e* is engaged with the upper folding-back portion 58*b* of the first conductor plate 53*c* and swaged in the up-down direction. The end portion 42 of the rod-like projectile 40 cuts, upon impinging on an upper surface of the conductor portion 50*g*, the first conductor plate 53*c* apart from the second conductor plate 53*d* and the third conductor plate 53*e* at swaging positions.

The present invention has been described as above. Of course, the present invention includes various forms of modifications within the scope thereof, and these modifications do not depart from the scope of the invention. All of what a person with ordinary skill in the art will clearly consider as a variation of the present invention is within the scope of the claims set forth below.

The invention claimed is:

1. An electric circuit breaker device comprising:

a housing made of synthetic resin;

a rod-like projectile made of synthetic resin and arranged in the housing;

a conductor portion arranged in the housing to extend across a front face of one end portion of the rod-like projectile; and an igniter arranged in the housing to face another end portion of the rod-like projectile and configured to generate pressure to fire the rod-like projectile toward the conductor portion, wherein the conductor portion comprises:

a first conductor plate extending across the front face of the one end portion of the rod-like projectile and comprising a recess portion, and a second conductor plate coupled to the recess portion of the first conductor plate, wherein the first conductor plate includes a recess portion having a reduced thickness compared to a remaining part of the first conductor plate, and the recess portion has a pair of grooves that facilitate cutting of the first conductor plate by the rod-like projectile.

2. The electric circuit breaker device according to claim 1, wherein the second conductor plate is welded to the first conductor plate at a central portion of one surface of the second conductor plate.

3. The electric circuit breaker device according to claim 1, wherein the second conductor plate is welded to the first conductor plate at a plurality of positions along an edge portion of one surface of the second conductor plate.

4. The electric circuit breaker device according to claim 1, wherein the second conductor plate comprises a pair of ridge portions mated with or press-fit into the pair of grooves of the first conductor plate.

5. An electric circuit breaker device comprising:

a housing made of synthetic resin;

a rod-like projectile made of synthetic resin and arranged in the housing;

a conductor portion arranged in the housing to extend across a front face of one end portion of the rod-like projectile; and an igniter arranged in the housing to face another end portion of the rod-like projectile and configured to generate pressure to fire the rod-like projectile toward the conductor portion, wherein the conductor portion comprises:

a first conductor plate arranged on the front face of the one end portion of the rod-like projectile, and a second conductor plate and a third conductor plate coupled, at a corresponding one of edge portions of the second conductor plate and the third conductor plate, to respective opposing edge portions of the first conductor plate, wherein the first conductor plate, the second conductor plate, and the third conductor plate define a cavity portion that accommodates the one end portion of the rod-like projectile.

6. The electric circuit breaker device according to claim 5, wherein the first conductor plate and each of the second conductor plate and the third conductor plate are arranged to overlap each other at a corresponding one of the edge portions of the second conductor plate and the third conductor plate and are welded together at overlapping portions between the first conductor plate and a corresponding one of the second conductor plate and the third conductor plate.

7. An electric circuit breaker device comprising:

a housing made of synthetic resin;

a rod-like projectile made of synthetic resin and arranged in the housing;

a conductor portion arranged in the housing to extend across a front face of one end portion of the rod-like projectile; and an igniter arranged in the housing to face another end portion of the rod-like projectile and configured to generate pressure to fire the rod-like projectile toward the conductor portion, wherein the conductor portion comprises:

a first conductor plate extending across the front face of the one end portion of the rod-like projectile and comprising a recess portion; and a second conductor plate coupled to the recess portion of the first conductor plate, wherein the first conductor plate comprises a groove or a ridge portion formed in or on an upper surface of each of the opposing edge portions, each of the second conductor plate and the third conductor plate comprises a corresponding ridge portion or a corresponding groove formed on or in a lower surface of a corresponding one of the edge portions of the second conductor plate and the third conductor plate, the first conductor plate and each of the second conductor plate and the third conductor plate are arranged to overlap each other at the edge portions of the first conductor plate and a corresponding one of the second conductor plate and the third conductor plate, and each of the grooves or the ridge portions of the first conductor plate and the ridge portion or the groove of a corresponding one of the second conductor plate and the third conductor plate are press-fit into each other.

8. An electric circuit breaker device comprising:

a housing made of synthetic resin;

a rod-like projectile made of synthetic resin and arranged in the housing;

a conductor portion arranged in the housing to extend across a front face of one end portion of the rod-like projectile; and an igniter arranged in the housing to face another end portion of the rod-like projectile and configured to generate pressure to fire the rod-like projectile toward the conductor portion, wherein the conductor portion comprises:

a first conductor plate extending across the front face of the one end portion of the rod-like projectile and comprising a recess portion; and a second conductor plate coupled to the recess portion of the first conductor plate, wherein the first conductor plate comprises a groove or a ridge portion formed in or on a side surface of each of the opposing edge portions, each of the second conductor plate and the third conductor plate comprises a corresponding ridge portion or a corresponding groove formed on or in a side surface of a corresponding one of the edge portions of the second conductor plate and the third conductor plate, the first conductor plate and each of the second conductor plate and the third conductor plate are arranged to be flush with each other at the edge portions of the first conductor plate and a corresponding one of the second conductor plate and the third conductor plate in a manner of butting against each other, and each of the grooves or the ridge portions of the first conductor plate and the ridge portion or the groove of a corresponding one of the second conductor plate and the third conductor plate are press-fit into each other.

9. An electric circuit breaker device comprising:

a housing made of synthetic resin;

a rod-like projectile made of synthetic resin and arranged in the housing;

a conductor portion arranged in the housing to extend across a front face of one end portion of the rod-like projectile; and an igniter arranged in the housing to face another end portion of the rod-like projectile and configured to generate pressure to fire the rod-like projectile toward the conductor portion, wherein the conductor portion comprises:

a first conductor plate extending across the front face of the one end portion of the rod-like projectile and comprising a recess portion; and a second conductor plate coupled to the recess portion of the first conductor plate, wherein the first conductor plate comprises an upper folding-back portion at each of the opposing edge portions, each of the second conductor plate and the third conductor plate comprises a lower folding-back portion at a corresponding one of the edge portions of the second conductor plate and the third conductor plate, and the lower folding-back portion of each of the second conductor plate and the third conductor plate is engaged and swaged with a corresponding one of the upper folding-back portions of the opposing edge portions of the first conductor plate.

* * * * *